United States Patent [19]

Bastian

[11] Patent Number: 4,750,305

[45] Date of Patent: Jun. 14, 1988

[54] CORNER POST ASSEMBLY

[75] Inventor: John M. Bastian, Manitowoc, Wis.

[73] Assignee: Hamilton Industries, Inc., Two Rivers, Wis.

[21] Appl. No.: 64,125

[22] Filed: Jun. 18, 1987

[51] Int. Cl.[4] ..... E04B 2/76

[52] U.S. Cl. ..... 52/127.11; 52/239; 52/632; 160/351

[58] Field of Search ..... 160/135, 351; 52/127.11, 239, 632, 241, 238.1, 282

[56] References Cited

U.S. PATENT DOCUMENTS

| | | | |
|---|---|---|---|
| 2,970,677 | 2/1961 | Springs | 52/239 |
| 3,447,824 | 6/1969 | Brown . | |
| 3,559,352 | 2/1971 | Magnuson | 52/239 |
| 3,762,116 | 10/1973 | Anderson | 52/239 |
| 3,809,142 | 5/1974 | Bleeker | 160/135 |
| 3,877,191 | 4/1975 | Munsey | 52/632 |
| 3,987,836 | 10/1976 | LeMay | 160/135 |
| 3,987,838 | 10/1976 | LaGue | 160/351 |
| 4,020,604 | 5/1977 | Legler | 52/65 |
| 4,021,973 | 5/1977 | Hegg | 52/36 |
| 4,024,686 | 5/1977 | Gronert | 52/282 |
| 4,104,838 | 8/1978 | Hage | 52/282 |
| 4,119,287 | 10/1978 | Mollenkopf | 248/243 |
| 4,129,163 | 12/1978 | Johnson | 160/135 |
| 4,546,889 | 10/1985 | Schoumaker | 211/105.3 |
| 4,601,146 | 7/1986 | Harter | 52/239 |
| 4,638,614 | 1/1987 | Wilcox | 52/239 |

*Primary Examiner*—John E. Murtagh

*Attorney, Agent, or Firm*—Tilton, Fallon, Lungmus

[57] ABSTRACT

A corner post assembly particularly useful for joining vertical panels, frames, and the like, in constructing modular work stations for laboratories, offices, and industrial sites. The assembly includes a cylindrical corner post tube typically having two or more (but at least one) vertical side members secured to the tube at selected angular positions thereabout. A pair of upper and lower end caps connect each side member to the tube and a vertical riser, which may be a frame component of a partition or movable wall assembly, is secured to each side member. The connecting elements perform multiple operations in use and are sufficiently concealed following assembly to provide a structure of smooth, attractive, and uncluttered appearance. Where plural panels are connected to a single tube, an indexing ring secured to the upper end of the tube may be used to limit the relative positions of such panels to angular increments that preferably are multiples of 30 degrees, with adjacent panels being no closer than 90 degrees. The indexing ring receives an extension tube that has its lower end portion telescoped into the upper portion of the corner post tube, and the locking element for securing the ring in place also functions to anchor the extension tube against sliding movement.

30 Claims, 4 Drawing Sheets

CORNER POST ASSEMBLY

BACKGROUND AND SUMMARY

The prior art contains a number of examples of space-dividing panel systems in which cylindrical corner post assemblies are used, such patents including, for example, U.S. Pat. Nos. 3,877,191, 3,809,142, 4,119,287, 4,546,889, 3,447,824, 4,024,686, 3,762,116, 4,020,604, 3,987,836, 4,129,163, 3,987,838, and 4,021,973. In general, such systems do not permit the corner posts to be connected to panels having a variety of vertical dimensions and designs. Often the assemblies are complex and utilize components requiring relatively expensive fabricating operations. Assembly is sometimes difficult, particularly if size (height) variations are to be accommodated, and the connecting elements, if concealed from view in the completed installation, may be awkward to reach when disassembly or repositioning of the space-dividing structure is required.

An important aspect of this invention therefore lies in providing an assembly that utilizes a simple cylindrical tube, preferably an extruded one, as the main supportive element, to which are joined other elements that may also be efficiently and relatively economically formed by extrusion. When the components are assembled, the means of attachment are generally concealed from view but are readily accessible should repositioning or disassembly of the parts be required. The main support tube is reinforced by one or more (usually two to four) side members that extend substantially the full length of the tube and are capable of being positioned about its circumference at angular positions that are multiples of 30 degrees, with any two adjacent side members being at least 90 degrees apart. Each side member has a generally planar vertical wall and a pair of inturned flanges angling inwardly in radial directions with respect to the main support tube. The means for connecting each side member to the support tube includes a pair of upper and lower end caps, each end cap having a generally horizontal end wall with integral hook and lug portions extending vertically in the same direction from that end wall. When the parts are assembled, the lug portion is disposed between the vertical wall of the side member and the support tube and the hook portion extends into the tube through one of its open ends. Screws may extend through openings in each side member and be threadedly received in apertures provided in the end caps, so that when the screws are tightened several actions simultaneously occur: The flanges of the side member are drawn into engagement with the support tube, the lug portions are urged into engagement with the inner surface of the side member's vertical wall, and the hook portions are brought into engagement with the ends of the tube, thereby locking all of such elements securely together.

A vertical riser, which may be a vertical structural member of a panel or screen, or a frame member for a shelf, rack, or storage assembly, is detachably secured to each side member. The riser is ordinarily of the same length as the side member but may be any selected length shorter than that member. Each riser is equipped with a cap at its upper end, and an upwardly-facing socket within the cap conceals a connector of the rotatable cam type. The cam surface of the connector is engagable with one end of a draw-pin, the other end being received in a vertical slot or channel extending along the planar wall of the side member. Upon rotation of the cam member, the draw-pin is retracted and the upper ends of the riser and side member are pulled tightly together. The coaction between the cam member, draw-pin, and other elements is such that in those instances where the riser and side member are of the same length, the aforementioned screws for securing the side members to the upper end caps and support tube may be eliminated and the multiple functions that would otherwise be performed by the screws, as indicated above, are assumed by the cam and draw-pin assembly.

Where the corner post assembly is to extend from floor to ceiling, a cylindrical extension tube is provided with its lower end telescopingly received within the upper end of the main support tube. A cap ring is connected to the upper end of the support tube and slidably receives the extension tube. In a preferred embodiment, a threaded connecting element extends through openings in a pair of spaced inner and outer collar portions of the cap ring and also through an apertured tongue projecting from the upper end cap of the assembly's side member. The end of the threaded connector also engages the extension tube, with the result that the connector performs dual functions of locking the cap ring in place and securing the extension tube against sliding movement. Also, since the cap ring includes ribs that cooperate with the tongue and end cap for indexing the angular position of one riser relative to another, the connector, by retaining the cap ring in place, simply and effectively maintains the risers in their selected angular positions.

Other advantages, features, and objects of the invention will become apparent from the specification and drawings.

DRAWINGS

DETAILED DESCRIPTION OF PREFERRED EMBODIMENTS

Figure 1:
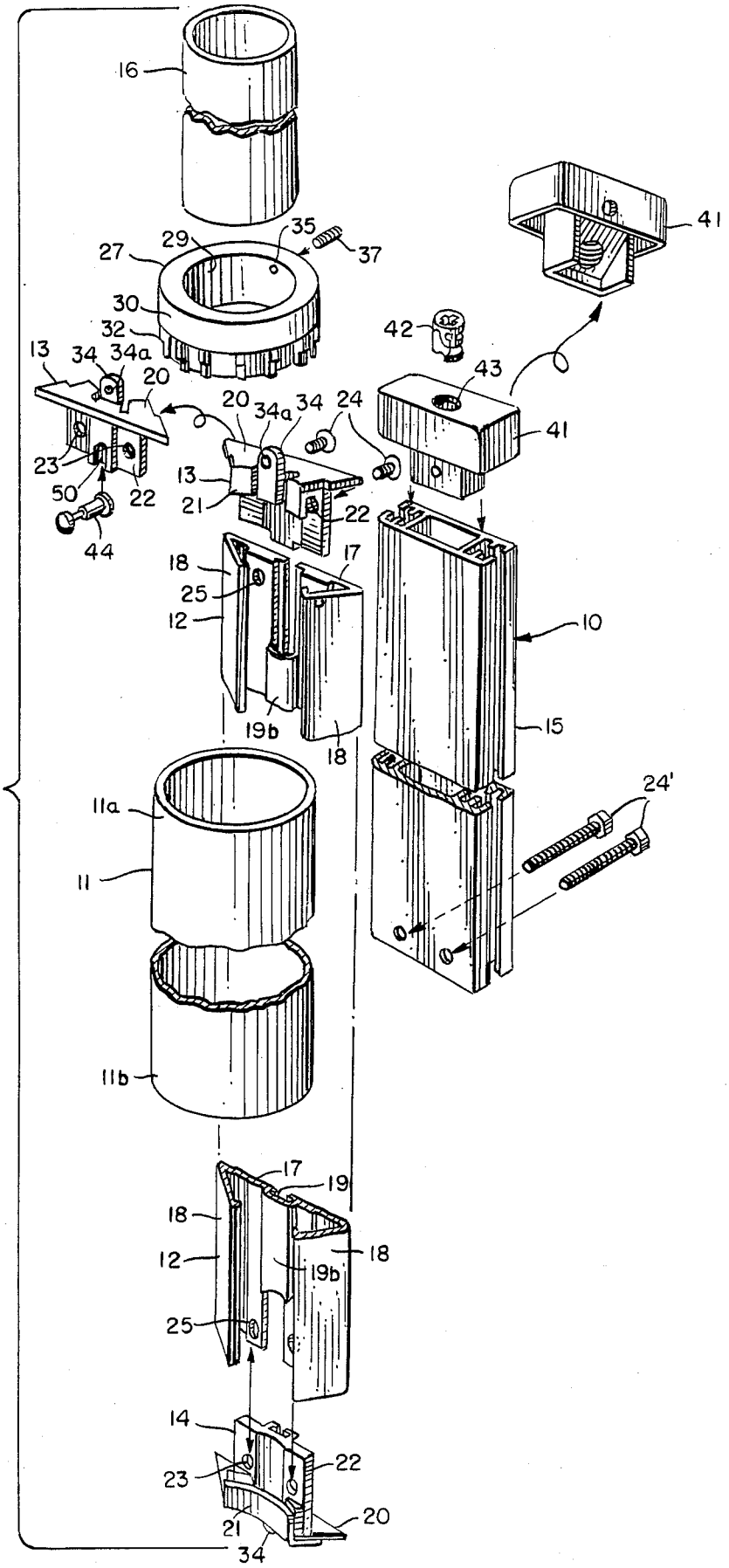
FIG. 1 is an exploded fragmentary perspective view illustrating the components of a corner post assembly embodying the invention.
Figure 2:
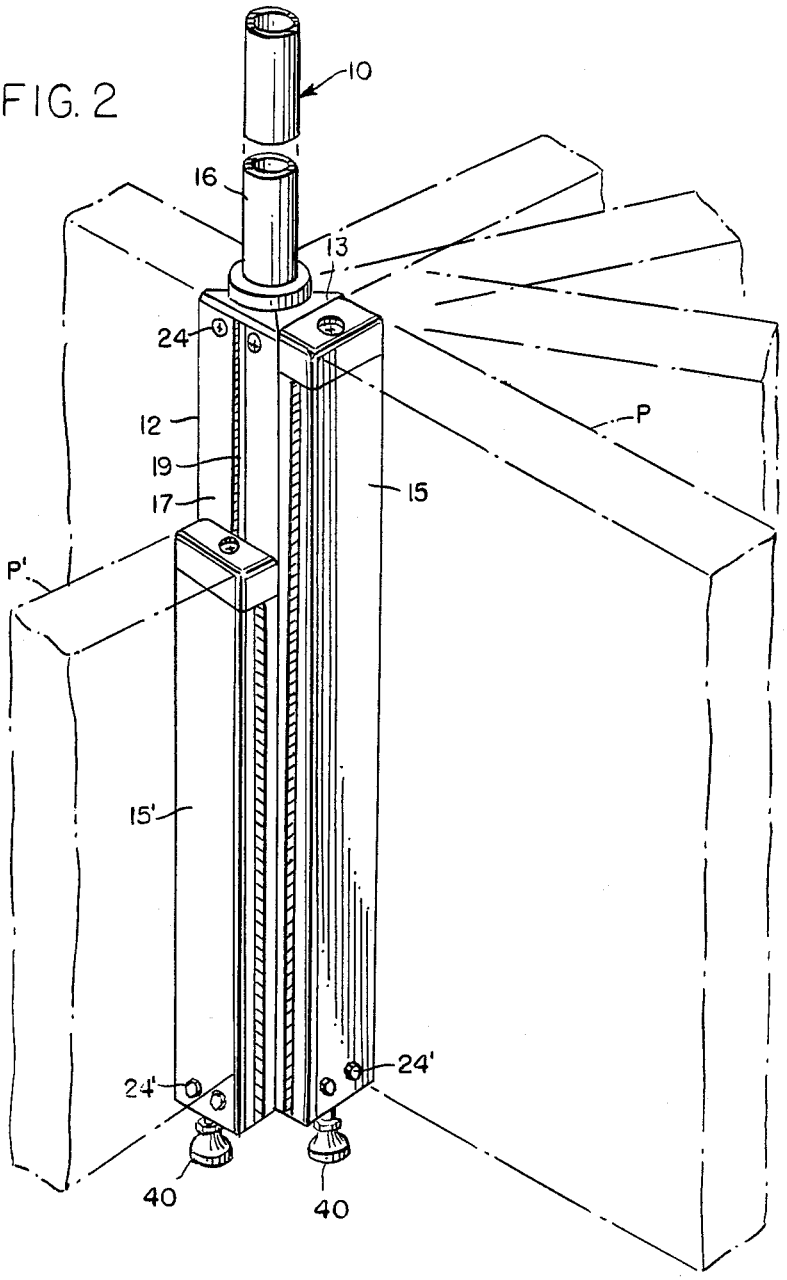
FIG. 2 is a perspective view of the components in assembled condition illustrating different arrangements and size relationships that might be selected by a user.
Figures 3, 4, 5, 6:
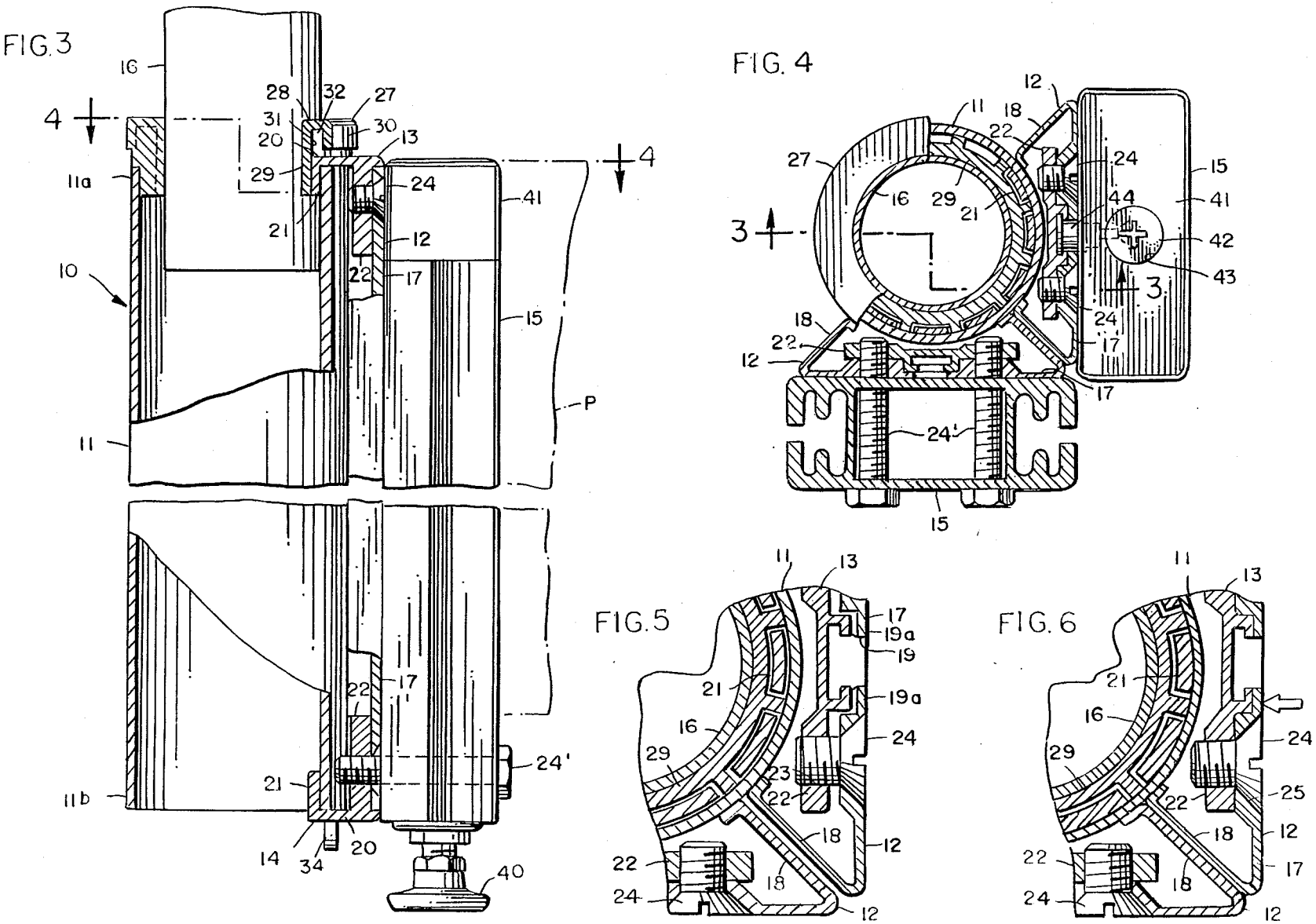
FIG. 3 is a fragmentary vertical sectional view taken along line 3—3 of FIG. 4.
FIG. 4 is a horizontal sectional view taken along line 4—4 of FIG. 3 except to the extent that the riser, shown in the lower portion of the figure, is taken in horizontal section to illustrate the relationship of parts at the lower end of the riser.
FIG. 5 is a fragmentary sectional view showing a corner post tube, side member, and end cap in an early stage of assembly.
FIG. 6 is a sectional view similar to FIG. 5 but showing the same parts in a final stage of assembly.

Referring to FIGS. 1–3, the numeral 10 generally designates a corner post assembly that includes a main support tube 11, at least one side member 12 extending alongside that tube for substantially its full length, a pair of upper and lower end caps 13 and 14, respectively that secure the side member 12 and tube 11 together as well as performing other functions, and a vertical riser 15 connected to each side member 12. The riser may extend the full height of the side member or, as indicated in FIG. 2, the riser 15' may have a length (height) less than that of the side member. Thus, the length of the riser may be selected to meet the needs of the user and to suit the requirements of a particular installation. The term "riser" is used here to mean a vertical member that would ordinarily be a component of a panel or frame structure intended to be connected to and supported by the corner post assembly. For example, in FIG. 2, risers 15 and 15' constitute the vertical side members of panel structures P and P', respectively. Whether the structure constitutes an open panel, a closed panel, or is used for screening or to provide support for shelving or furniture components, is not material to this disclosure. Panel structures and their uses are well known in the art and, for purposes of describing this invention, it is believed sufficient to point out that the utility of the riser lies in the fact that it constitutes the side member of what might otherwise be a conventional panel or frame structure.

Most advantageously, the corner post support tube 11 is cylindrical in shape and is extruded from aluminum or other suitable material. As shown in FIGS. 1 and 3, the tube is open at its upper and lower ends, and an extension tube 16 of smaller outside diameter than the inside diameter of tube 11 is telescopingly received within the upper end of the main support tube 11. In use, the extension tube 16 might be provided at its upper end with a fitting (not shown) for ceiling attachment and, since the tubes are hollow, electrical wiring may be disposed within the tubes for supplying electricity to outlets and equipment in the work spaces defined by a plurality of connected panels and corner post assemblies. In that regard, it will be observed that the lower end of tube 11 remains open and spaced above a floor surface in a completed installation (FIG. 3); therefore, electrical cables may be easily extended to the work stations through that tube.

Each side member 12, which may also be formed by extrusion, is coextensive in length with main tube 11 and includes a generally planar vertical wall 17 and a pair of inturned flanges 18 that, in the completed assembly, angle inwardly along vertical planes extending radially with respect to tube 11. In the embodiment illustrated, the inturned flanges 18 extend at angles of 45 degrees with respect to the planar wall 17 of each side member 12.

Wall 17 is provided with an outwardly-facing channel or slot 19. The opening of the channel is reduced by longitudinal flanges **19*a* and, at the upper and lower ends of the side member 12, portions of inner wall 19*b* defining the inner limits of the channel are cut away (FIG. 1**).

End caps 13 and 14 may be of identical construction. Each end cap includes a generally horizontal end wall 20 and integral hook and lug portions 21 and 22, respectively, that extend vertically in the same direction from the end wall. As shown most clearly in FIGS. 3 and 7, the lug portion 22 is disposed between the vertical planar wall 17 of side member 12 and the wall of tube 11. The lug portion is provided with at least one threaded opening 23—preferably a pair of such openings as shown most clearly in FIG. 1—for receiving connecting means in the form of screws 24. The screws extend through openings 25 formed in the upper and lower ends of the side member 12 (FIG. 1). Hook portion 21 is received within the main tube 11 through one of the open ends of that tube.

When the screws 24 of the upper end cap 13 are tightened, several actions occur simultaneously (see FIGS. 5 and 6). In FIG. 5, the screws 24 for the side member 12 shown on the right have not been fully tightened. As such screws are tightened, the inturned flanges 18 of the side member 12 are urged into tight engagement with the side wall of the tube 11, the hook portion 21 of the end cap is drawn into forceful engagement with the inner surface of the tube 11, and the lug portion 22 is advanced into engagement with the inner surface of the vertical wall 17 of the side member (FIG. 6). The side member, end cap, and upper end of the tube are therefore locked together upon tightening of screws 24.

The same action occurs at the lower end of the side member 12 although, in the preferred embodiment, screws 24' are longer and extend through riser 15 as well as through wall 17 of the side member. The arrangement is illustrated in the lower portion of FIG. 4 where the riser is shown in horizontal section and the relatively long screws 24' that pass through the riser at its lower end are revealed. While the relatively short screws 24 used at the upper end might also be used at the lower end of the side member in the same manner already described, it is preferred to utilize the longer screws 24' since they perform the additional function of anchoring the riser's lower end in place. Even if the heads of screws 24' were exposed, they would not be in conspicuous locations. Ordinarily, however, the heads of screws 24' would be concealed by the panels P and P' which would either terminate just above the lower ends of the risers or be open along their undersides to provide access to the screws.

While the drawings show two side members 12 connected to the main tube 11 of the corner post assembly, it is believed apparent that two additional side members might be so connected, thereby encasing the entire outer surface of the tube and converting the appearance of the structure into one of rectangular (square) cross-sectional configuration. Also, while the drawings show the side members, and the risers connected to them, disposed at 90 degrees with respect to each other, a variety of other angular relationships are possible. Specifically, the side member 13 and riser 15 that support panel P in FIG. 2 might instead be shifted at selected increments, preferably 30 degree increments, into any of the alternate positions shown in phantom in the upper portion of that figure. For the preferred construction depicted in the drawings, the primary governing limitation is that any two panels cannot be separated by an angular distance less than 90 degrees. In addition, control means are provided so that the angular distance must also be a multiple of 30 degrees. Thus, any two panels may be positioned 90, 120, and 180 degrees apart, with a maximum number of four panels and with no two panels being closer than 90 degrees apart. While increments of 30 degrees are believed particularly effective because they allow equal angular spacing of multiple panels in either an "X" or "Y" configuration when viewed in plan, it will be evident from the following that, if desired, such increments may be made smaller (e.g., 15 degrees) or greater (e.g., 45 degrees) to suit the needs and preferences of users. Also, as explained hereinafter, the means for controlling the incremental spacing may be omitted entirely, allowing the side members and panels to assume any angular spacing as long as adjacent panels are (preferably) not closer than 90 degrees.

Figure 7:
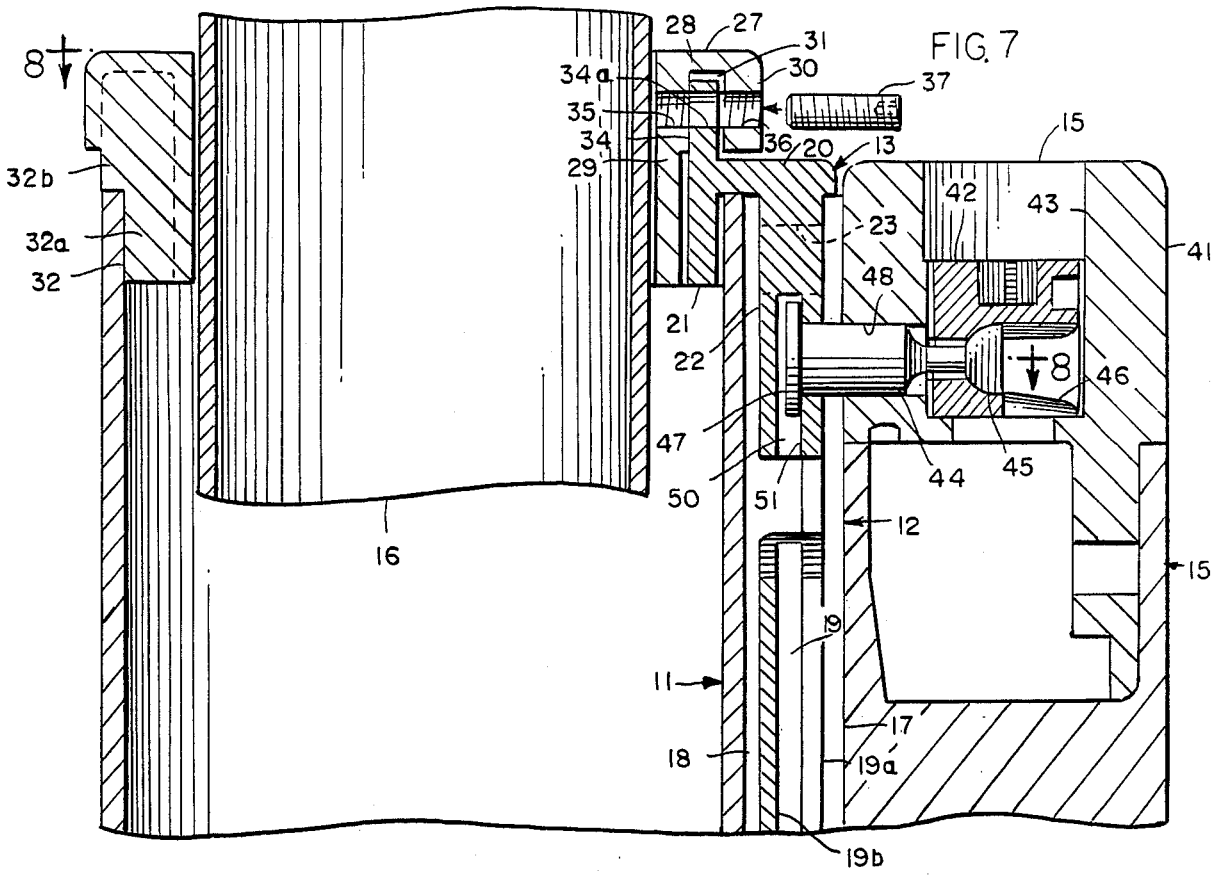
FIG. 7 is a fragmentary vertical sectional view illustrating the means for attaching a riser and a telescoping extension tube to the other components.
Figure 8:
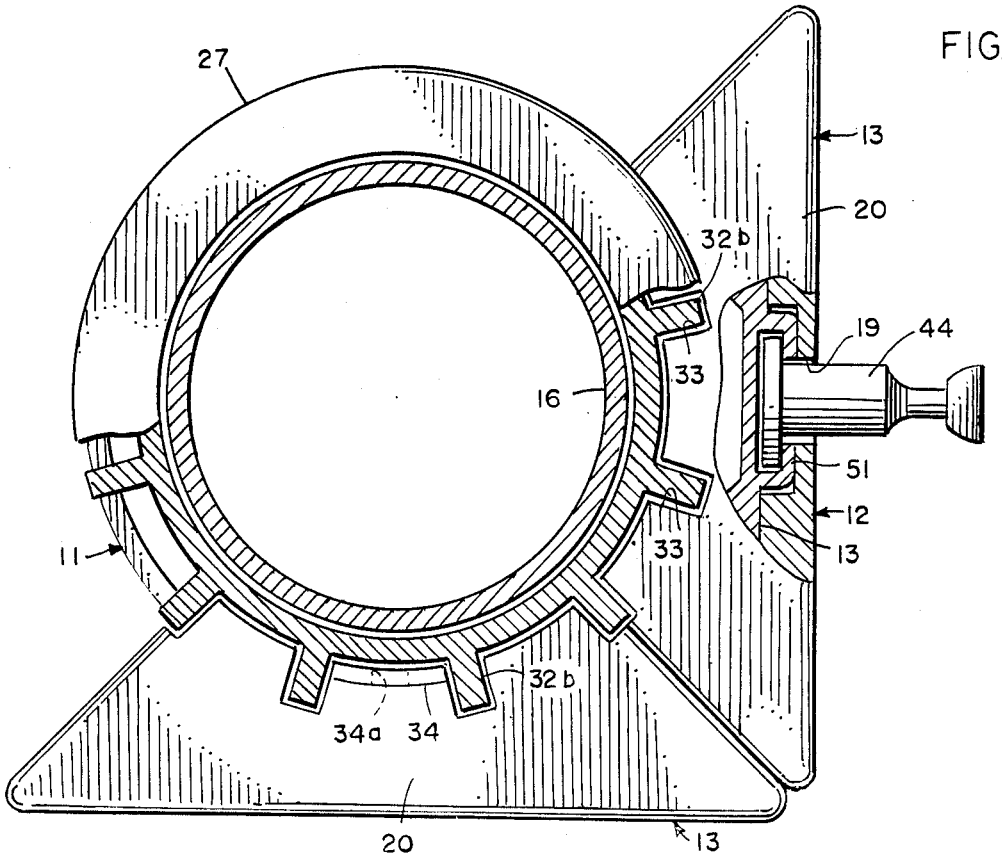
FIG. 8 is a horizontal sectional view taken along line 8—8 of FIG. 7, the view being partially broken away to illustrate details of construction.

The means for controlling the positions of the side members 12 (and the risers and panels connected to them) at increments of 30 degrees includes a cap ring 27 that, as shown in FIGS. 3 and 7 is provided with an upper wall portion 28, a downwardly-extending cylindrical inner collar portion 29, and a downwardly-extending cylindrical outer collar portion 30. The concentric inner and outer collar portions are spaced radially apart to define a downwardly-facing annular channel 31. A series of circumferentially-spaced radially-extending ribs 32 project outwardly from the inner collar portion and bridge the inner and outer collar portions within channel 31. The inner collar portion and its ribs extend well below the lower limits of the outer collar portion, and the lower ends 32*a* of the ribs are dimensioned to engage, or be positioned in close proximity to, the inner surface of tube 11 (FIG. 7). The upper ends 32*b* of the ribs are of larger radial dimension, approximating that of the outer surface of tube 11. As illustrated most clearly in FIG. 8, the upper ends of the ribs project radially outwardly into notches or recesses 33 formed in the top wall 20 and in the hook portion 21 of end cap 13. Since the notches and ribs are spaced apart angular distances of 30 degrees, the cap ring 27 with its ribs 32 insures that the angular distance between any two side members 13 must be some multiple of 30 degrees.

The upper end cap 13 is provided with an upstanding integral tongue 34 that projects above the upper horizontal surface of top wall 20 (FIG. 1) and that has an opening 34*a* therethrough. The tongue is dimensioned to fit between a pair of ribs 32 so that when the parts are fitted together the tongue is received in downwardly-facing channel 31 of the cap ring 27. As depicted in FIG. 7, the inner and outer collar portions of the cap ring are provided with threaded openings 35, 36 that are alignable with the opening 34*a* in the tongue. A screw 37 may be extended through all three openings to secure the cap ring to end cap 13 and thereby lock the cap ring upon the end of main tube 11. Moreover, tightening of screw 37 brings the inner end of that screw into forceful contact with the outer surface of extension tube 16. Screw 37, end cap 13, and cap ring 27 therefore perform multiple functions in detachably securing the parts of the assembly together.

The lower end cap 14 is shown in the drawings to be identical in construction with upper end cap 13. If desired, however, the tongue 34 may be eliminated from the lower end cap because it performs no function at that end of the corner post assembly. Similarly, the notches 33 may be omitted from lower end cap 14 because they serve no purpose at the lower end in the absence of a lower cap ring. It should also be understood that, if desired, notches 33 may be eliminated from the upper cap ring 13, and ribs 32 may be omitted from that cap ring, so that the angular positioning of the side members 12 will not be restricted to increments of 30 degrees. While indexing at 30 degree increments is believed highly desirable in facilitating the installation of a space-dividing system, and in insuring that the side members, risers, and panels will remain in their selected positions of adjustment, the ribs and notches may be omitted in those instances where such advantages are not required.

Each riser 15 (or 15') is self-supporting, being provided at its lower end with an adjustable floor-engaging foot or shoe assembly 40 (FIGS. 2,3). At its upper end, the riser is provided with a riser cap 41 that closes off the openings or channels of the extruded riser and gives the riser assembly a finished appearance. In a typical installation, the riser cap 41 has its upper surface coplanar with upper end cap 13, with the result that the riser conceals the screws 24 or at least the openings for such screws.

Each riser is constructed so that the means for attaching its upper end to side member 12 is not readily apparent. Such means takes the form of a rotatable cam connector 42 disposed within upwardly-opening socket 43 in riser cap 41 (FIGS. 1,4,7). Connectors of the general type shown are well known and commercially available (e.g., Hafele America, High Point, N.C.), and a detailed discussion of their structure and operation is therefore believed unnecessary herein.

Figure 10:
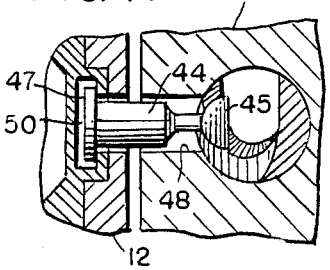
FIGS. 10 and 10A are horizontal sectional views illustrating the coaction of the camming connector and draw-pin before the connector is tightened.
Figure 11:
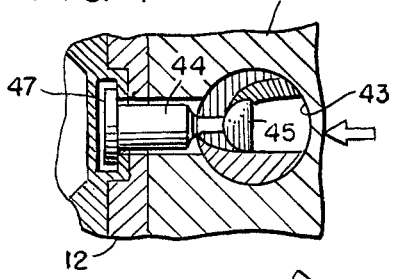
FIGS. 11 and 11A illustrate the relationship after the connector is tightened.
Figure 9:
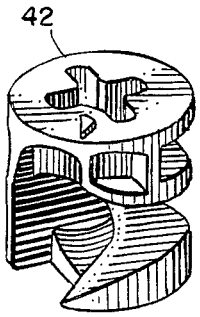
FIG. 9 is a perspective view of a camming connector fused in the corner post assembly.
Figure 10A:
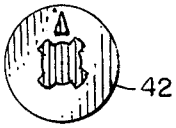
Figure 11A:
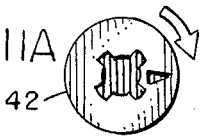

Rotatable connector 42 cooperates with a double-headed draw-pin 44, with one head 45 being received within the cam recess 46 of the connector and the other head 47 being retained by side member 12 and (in most cases) end cap 13. The shaft of the pin extends through a horizontal bore 48 in the riser cap (FIG. 7). Upon rotation of the connector by means of a suitable tool, such as a screw driver or hex wrench, inserted int socket 43, the pin is cammed from an extended position (FIG. 10) into a retracted position (FIG. 11). FIGS. 10, 10A, 11, and llA indicate the extent of angular movement (approximately 90 degrees) required to shift the draw-pin between its extended and retracted positions. If the cam connector is rotated counterclockwise 90 degrees from the position indicated in FIGS. 10 and 10A, then complete disengagement between the pin and connector may take place. The total range of angular movement between disengagement and complete retraction is therefore approximately 180 degrees.

The shank of the draw-pin 44 may extend through channel or slot 19 of the side member 12 at any suitable point along the length of that channel, the particular location depending on the length of the riser 15 that is detachably connected to that side member. If the riser is coextensive in length with the side member, as shown in FIG. 7, then the enlarged head 47 of the pin is received within recess 50 of the upper end cap 13. Since the head bears against the flanges 51 of the end cap when the draw-pin is retracted, the end cap 13 performs a reinforcing and connecting function in joining the riser 15 to the side member 12, in addition to its previously-described functions of securing together the side member, main tube, and cap ring. Since the recess 50 of the end cap 13 aligns and communicates directly with the channel 19 of the side member 12, the draw-pin 44 may be slid downwardly into any selected position along the length of the channel when a riser 15' of lesser height than the side member is to be used.

Referring to FIGS. 3 and 4, where riser 15 and its cap 41 are shown to be of the same height as side member 17 and its end cap 13, it will be noted that both screws 24 and draw-pin 44 (and its cam member 42) are used concurrently at the upper end of the corner post assembly for the purpose of holding the parts together. Under such circumstances, however, screws 24 may be considered redundant and, although they may be retained to provide increased security or for other reasons, such screws may be omitted entirely and the multiple functions that would otherwise be performed by such screws may instead be performed by draw-pin 44, cam member 42, and the elements coacting with them. Thus, in FIG. 7, the screws are omitted from threaded openings 23 and the functions that would otherwise be performed by such screws are assumed by draw-pin 44 and cam member 42. When the cam member 42 is rotated to retract draw-pin 44, the draw-pin not only urges the riser 15 and side member 12 tightly together but also, at the same time, draws the flanges of side member 12 into tight engagement with the support tube 11, urges the lug portions 22 of the upper end cap 13 into engagement with the inner surface of the side member's vertical wall 17, and moves the hook portions 21 of that end cap into contact with the inner surface of the tube 11. Simply by rotating the cam member 42 to shift the draw-pin into its retracted position, the upper ends of all of the main elements of the corner post assembly—the riser, side member, riser cap, upper end cap, and support tube—are locked securely together.

It is believed apparent that there are instances where the use of screws 24 is essential. If, for some reason, side member 12 is to be secured to a support tube without attachment of a riser 15, then screws 24 must be used to join the parts together, such screws then performing the multiple functions originally described. Also, if a riser and side member are not co-extensive in length (height), screws must be used to secure the upper end of the side member to the support tube. For example, in FIG. 2, screws 24 are used to hold the upper end of the left side member 12 in place because riser 15' is substantially shorter than the side member.

While in the foregoing, embodiments of the invention have been described in considerable detail for purposes of illustration, it will be understood by those skilled in the art that many of these details may be varied without departing from the spirit and scope of the invention.

I claim:

1. A corner post assembly comprising a vertical corner post tube having open upper and lower ends; at least one elongated side member extending vertically alongside substantially the full length of said tube; said side member having a generally planar vertical wall with inner and outer surfaces and a pair of inturned flanges extending inwardly along vertical planes disposed radially with respect to said tube; said vertical wall having upper and lower end portions each provided with at least one horizontal opening therethrough; connecting means for connecting said side member to said tube comprising a pair of upper and lower end caps for said side member; each end cap including an end wall and integral hook and lug portions extending vertically in the same direction from said end wall; said lug portion being disposed between said vertical wall and said tube and having a threaded aperture aligned with one of said upper and lower openings of said vertical wall; said hook portion being received in said tube through one of said open upper and lower ends thereof; and screw means extending through each of said openings of said side member, and threadedly received by said apertures of said end caps, for simultaneously (a) urging said flanges of said side member into engagement with said tube, (b) shifting said lug portions towards the inner surface of said vertical wall, and (c) drawing said hook portions into engagement with the ends of said tube, upon tightening of said screw means.

2. The assembly of claim 1 in which a vertically-elongated riser extends along said vertical wall of said side member; said riser having upper and lower end portions provided with means for detachably securing said riser to said vertical wall.

3. The assembly of claim 2 in which said means for detachably securing said riser to said vertical wall includes a riser cap at the upper end of said riser; said cap having an upwardly opening socket therein and having a lateral bore communicating with said socket; a double-headed draw-pin extendable through said bore into said socket; said draw-pin having one head thereof receivable in said socket and the other head thereof connected to said side member; and rotatable camming means within said socket for engaging said one head and for retracting said draw-pin when said camming means is rotated by a tool inserted into said socket.

4. The assembly of claim 3 in which said vertical wall of said side member has a vertical channel extending therealong; said draw-pin being slidable along said channel for positioning said draw-pin at the elevation of said riser cap.

5. The assembly of claim 4 in which said riser cap is positioned at the same height as said upper end cap of said side member.

6. The assembly of claim 4 in which said riser cap is positioned at an elevation below that of said upper end cap of said side member.

7. The assembly of claims 2 or 3 in which said screw means at the lower end portion of said vertical wall also extends through at least one opening in the lower end portion of said riser for connecting said riser, side member, lower end cap, and tube together.

8. The assembly of claim 2 in which said riser constitutes a vertical component of a space-dividing partition.

9. The assembly of claims 1 or 2 in which each of said inturned flanges extends inwardly from said vertical wall at an included angle of approximately 45 degrees.

10. The assembly of claim 2 in which said side member, riser, and tube are of extruded construction.

11. The assembly of claim 1 in which a cap ring is mounted on said tube at the upper end thereof; said cap ring including a cylindrical inner collar portion received within the opening at the upper end of said tube, and a concentric outer collar portion spaced outwardly from said inner collar portion to define a downwardly-facing annular channel between said inner and outer collar portions; said upper end cap having an upstanding integral tongue received within said downwardly-facing annular channel; and means releasably securing said tongue within said annular channel to anchor said cap ring upon said tube.

12. The assembly of claim 11 in which said outer collar portion is provided with a threaded opening therethrough; said means for releasably securing said tongue within said channel comprising a locking screw threadedly received within said opening of said collar portion and engaging said tongue.

13. The assembly of claim 12 in which said tongue is provided with an opening alignable with said threaded opening of said outer collar portion for receiving said locking screw.

14. The assembly of claim 13 in which an extension tube is coaxial with said corner post tube and has a lower end portion slidably received by said cap ring; said inner collar portion having a threaded opening aligned with said openings in said outer collar portion and said tongue; said locking screw extending through said openings of said collar portions and said tongue and forceably engaging said extension tube for securing said extension tube against sliding movement within said cap ring while simultaneously locking said cap ring and end cap together.

15. The assembly of claim 11 in which said cap ring also includes a plurality of radially-extending circumferentially-spaced ribs within said annular channel; said upper end cap having its end wall provided with radially extending notches for receiving said ribs.

16. The assembly of claim 15 in which said ribs of said cap ring and said notches of said end cap are spaced apart angular distances of 30 degrees.

17. The assembly of claim 15 in which said tongue is received within the annular channel of said cap ring in a space between adjacent ribs.

18. The assembly of claims 1, 11, or 15 in which said assembly includes a second side member, second connecting means, and second screw means substantially identical to the first-mentioned side member, first-mentioned connecting means, and first-mentioned screw means, respectively; said second side member being secured to said tube by said second connecting means and said second screw means.

19. A corner post assembly comprising a vertical corner post tube having open upper and lower ends; at least one elongated side member extending vertically alongside substantially the full length of said tube; said side member having a generally planar vertical wall with inner and outer surfaces and a pair of inturned flanges extending inwardly along vertical planes disposed radially with respect to said tube; connecting means for connecting said side member to said tube comprising a pair of upper and lower end caps for said side member; each end cap including an end wall with integral hook and lug portions extending vertically in the same direction from said end wall; said lug portion being disposed between said vertical wall and said tube and said hook portion being received in said tube through one of said open upper and lower ends thereof; a vertically-elongated riser extending along said vertical wall of said side member; a riser cap mounted on said riser at the upper end thereof; said riser cap being located at substantially the same elevation as said upper end cap of said side member; and locking means for simultaneously (a) urging said riser and side member together, (b) urging said flanges of said side member into engagement with said tube, (c) shifting said lug portions towards the inner surface of said vertical wall, and (d) drawing said hook portions into engagement with the ends of said tube.

20. The assembly of claim 19 in which said riser cap is provided with an upwardly opening socket therein and a lateral bore communicating with said socket; said locking means including a double-headed draw-pin extendable through said bore into said socket; said draw-pin having one head thereof receivable in said socket and the other head thereof connected to said side member; and rotatable camming means within said socket for engaging said one head and for retracting said draw-pin when said camming means is rotated by a tool inserted into said socket.

21. The assembly of claims 19 or 20 in which said vertical wall includes a lower end portion provided with at least one horizontal opening therethrough; said lug portion of said lower end cap having a threaded aperture aligned with said lower opening of said vertical wall; and said riser having an opening at the lower end thereof aligned with said threaded aperture of said lug portion and said horizontal opening of said vertical wall; said locking means including screw means extending through said aligned openings and aperture for simultaneously securing together the lower end portion of said riser, said lower end cap, the lower end of said side member, and the lower end portion of said tube.

22. The assembly of claim 21 in which said vertical wall of said side member has a vertical channel extending therealong; said upper end cap having a recess aligned with said channel and receiving said other head of said double-headed draw-pin.

23. The assembly of claim 19 in which each of said inturned flanges extends inwardly from said vertical wall at an included angle of approximately 45 degrees.

24. The assembly of claim 19 in which a cap ring is mounted on said tube at the upper end thereof; said cap ring including a cylindrical inner collar portion received within the opening at the upper end of said tube, and a concentric outer collar portion spaced outwardly from said inner collar portion to define a downwardly-facing annular channel between said inner and outer collar portions; said upper end cap having an upstanding internal tongue received within said downwardly-facing annular channel; and means releasably securing said tongue within said annular channel to anchor said cap ring upon said tube.

25. The assembly of claim 24 in which said outer collar portion is provided with a threaded opening therethrough; said means for releasably securing said tongue within said channel comprising a locking screw threadedly received within said opening of said collar portion and engaging said tongue.

26. The assembly of claim 25 in which said tongue is provided with an opening alignable with said threaded opening of said outer collar portion for receiving said locking screw.

27. The assembly of claim 26 in which an extension tube is coaxial with said corner post tube and has a lower end portion slidably received by said cap ring; said inner collar portion having a threaded opening aligned with said openings in said outer collar portion and said tongue; said locking screw extending through said openings of said collar portions and said tongue and forceably engaging said extension tube for securing said extension tube against sliding movement within said cap while simultaneously locking said cap ring and end cap together.

28. The assembly of claim 25 in which said cap ring also includes a plurality of radially-extending circumferentially-spaced ribs within said annular channel; said upper end cap having its end wall provided with radially-extending notches for receiving said ribs.

29. The assembly of claim 28 in which said ribs of said cap ring and said notches of said end cap are spaced apart angular distances of 30 degrees.

30. The assembly of claim 28 in which said tongue is received within the annular channel of said cap ring in a space between adjacent ribs.

* * * * *